US011241725B2

(12) United States Patent
Huang et al.

(10) Patent No.: US 11,241,725 B2
(45) Date of Patent: Feb. 8, 2022

(54) METHOD FOR ROLLING METAL COMPOSITE PLATE STRIP

(71) Applicant: TAIYUAN UNIVERSITY OF SCIENCE AND TECHNOLOGY, Taiyuan (CN)

(72) Inventors: Qingxue Huang, Taiyuan (CN); Lin Zhu, Taiyuan (CN); Yugui Li, Taiyuan (CN); Cunlong Zhou, Taiyuan (CN); Lifeng Ma, Taiyuan (CN); Guanghui Zhao, Taiyuan (CN); Jiang Zhang, Taiyuan (CN)

(73) Assignee: TAIYUAN UNIVERSITY OF SCIENCE AND TECHNOLOGY, Taiyuan (CN)

( * ) Notice: Subject to any disclaimer, the term of this patent is extended or adjusted under 35 U.S.C. 154(b) by 1134 days.

(21) Appl. No.: 15/167,413

(22) Filed: May 27, 2016

(65) Prior Publication Data

US 2016/0271664 A1 Sep. 22, 2016

Related U.S. Application Data

(63) Continuation of application No. PCT/CN2014/000272, filed on Mar. 14, 2014.

(30) Foreign Application Priority Data

Jan. 22, 2014 (CN) ..... 201410028776.4

(51) Int. Cl.
*B21B 1/22* (2006.01)
*B21B 1/38* (2006.01)
(Continued)

(52) U.S. Cl.
CPC ..... *B21B 1/22* (2013.01); *B21B 1/38* (2013.01); *B21D 13/04* (2013.01); *B21H 8/005* (2013.01)

(58) Field of Classification Search
CPC .. B21B 1/38; B21B 1/22; B21H 8/005; B21D 13/04
(Continued)

(56) References Cited

U.S. PATENT DOCUMENTS 2,316,801 A * 4/1943 McLaughlin ..... B21B 15/00 318/7
3,159,911 A * 12/1964 Albert ..... B21C 37/0815 138/171
(Continued)

FOREIGN PATENT DOCUMENTS

CN 1123718 A 6/1996
CN 101829676 A 9/2010
(Continued)

OTHER PUBLICATIONS

Taiyuan University of Science and Technology, International Search Report and Written Opinion, PCT/CN2014/000272, dated Sep. 15, 2014, 16 pgs.
(Continued)

*Primary Examiner* — Dana Ross
*Assistant Examiner* — Kuangyue Chen
(74) *Attorney, Agent, or Firm* — Morgan, Lewis & Bockius LLP

(57) ABSTRACT

The present invention discloses a method for rolling a metal composite plate/strip, comprising the following steps: 1) selecting a metal base plate and a metal cladding plate, cleaning the surfaces of the base plate and the cladding plate to be composited until the metal matrixes are exposed; 2) sequentially laminating the base plate and the cladding plate to obtain a composite plate slab; 3) rolling the composite plate slab through a composite rough rolling mill having a corrugated roll to obtain a composite plate having a corrugated mating surface on its composite surface; and 4)
(Continued)

flattening the composite plate having a complete corrugated cladding plate by a composite finish rolling mill to a desirable thickness to obtain a composite plate/strip.

9 Claims, 10 Drawing Sheets

(51) Int. Cl.
*B21D 13/04* (2006.01)
*B21H 8/00* (2006.01)

(58) Field of Classification Search
USPC ..... 219/73
See application file for complete search history.

(56) References Cited

U.S. PATENT DOCUMENTS 4,927,070 A * 5/1990 Kretchmer ..... B21B 1/38 228/155
6,994,917 B2 * 2/2006 Kinoshita ..... B23K 20/04 228/190
2001/0054638 A1 * 12/2001 Hardwick ..... B23K 20/227 228/107
2005/0000262 A1 * 1/2005 Schreiber ..... B21B 1/227 72/197
2011/0186141 A1 * 8/2011 Bourgier ..... C23C 2/003 137/15.01
2016/0167096 A1 * 6/2016 Sanders ..... B21B 3/00 72/199

FOREIGN PATENT DOCUMENTS

CN 103272842 A * 9/2013
JP S61259807 A 11/1986

OTHER PUBLICATIONS

Taiyuan University of Science and Technology, International Preliminary Report on Patentability, PCT/CN2014/000272, dated Jul. 26, 2016, 5 pgs.

* cited by examiner

METHOD FOR ROLLING METAL COMPOSITE PLATE STRIP

RELATED APPLICATIONS

This application is a continuation application of PCT Patent Application No. PCT/CN2014/000272, entitled "METHOD FOR ROLLING METAL COMPOSITE PLATE STRIP" filed on Mar. 14, 2014, which claims priority to Chinese Patent Application No. 201410028776.4, entitled "METHOD FOR ROLLING METAL COMPOSITE PLATE STRIP," filed on Jan. 22, 2014, both of which are hereby incorporated by reference in their entirety.

TECHNICAL FIELD

The present invention relates to the technical field of preparation of a metal composite plate or strip, and in particular to a method for rolling a metal composite plate by mating the corrugated composite surface of a base plate with that of a clapping plate.

BACKGROUND OF THE INVENTION

Metal composite plate or strip refers to a plate or strip by compositing another metal plate or strip onto a layer of metal to achieve the effect of resource saving and cost reduction without reducing the effect in use (anti-corrosion performance, mechanical strength, etc.). With the technology of metal composite material, the respective advantage of each of constituent element material can be exerted, to achieve optimum allocation of each of constituent element material, save valuable metallic material, achieve required performance which the single metal cannot meet. Metal composite plate/strip is mainly used in various industries such as anti-corrosion, pressure vessel manufacture, electricity build, petrification, pharmaceuticals, light industry and automobile etc. For the compositing method, generally there are compositing method by explosion and compositing method by metal pressure processing.

The compositing method by explosion involves compactly welding the dissimilar metal plates together by using the high energy produced by explosion, which can achieve the composition of metals which have a great difference in performance and has the strong interface binding force. However the composite by this method has smaller size and poor shape and lower yield. Furthermore, the high energy impact of explosion affects metal structure and greatly influences the environmental pollution.

The compositing method by pressure processing refers to that the distance of contact surfaces of dissimilar metals affected by deforming force during plastic deformation approaches to the thick of an atom to form a number of bonding point, so as to diffuse to form steady metallurgical bonding. Process for slab and interface compositing mechanism are main factors constraining the quality and yield of composite metal plate/strip. Rolling compositing is the most studied method among pressure processing method, comprising hot rolling, cold rolling, non-isothermal rolling and asymmetrical rolling etc. However rolling has lower compositing energy, there is great difference of material mechanical property between dissimilar metals. The bonding interface is more complex than that in explosion compositing, wherein a bonding surface of composite slab by casting may easily produce bubble and lard crack and so on. Selection of the brazing flux for brazing compositing slab greatly affects the interface bonding of different metals and results in cracking. So how to get steady interface bonding of dissimilar metals, high quality precision, broad product scope, and high compositing efficiency are the urgent problems to be solved.

SUMMARY

The present invention is directed to provide a method for rolling a metal composite plate/strip (or clad plate/strip) by corrugated composite surfaces mating, in order to solve the technical problem of poor bonding of the composite interfaces during the composite plate production.

The present invention is achieved by the following technical scheme.

A method for rolling a metal composite plate/strip comprises the following steps:

1) selecting a metal base plate and a metal cladding plate, cleaning the surfaces of the base plate and the cladding plate to be composited until the metal matrixes are exposed;

2) sequentially laminating the base plate and the cladding plate, and making a slab, to obtain a composite plate slab;

3) rolling the composite plate slab through a composite rough rolling mill having a corrugated roll to obtain a composite plate having a corrugated mating surface on its composite surface;

4) flattening the composite plate having a complete corrugated cladding plate by a composite finish rolling mill, and rolling to a desirable thickness, to obtain a composite plate/strip.

Wherein the cladding plate is one piece, the deformation resistance of the cladding plate is greater than that of the base plate, and the composite rough rolling mill is a two-high rolling mill with one roll having toothed surface and the other roll having smooth surface so that the rolling is performed by allowing the roll having toothed surface to be in contact with the cladding plate and the roll having smooth surface to be in contact with the base plate.

Alternatively, the cladding plate is two pieces located respectively at the upper and lower surfaces of the base plate, the deformation resistance of the cladding plate is greater than that of the base plate, and the composite rough rolling mill is a two-high rolling mill with both rolls having toothed surfaces so that the rolling is performed by allowing the rolls having toothed surface to be in contact with the upper and lower cladding plates.

Wherein the slab-making process of step 2) is: feeding the laminated base plate and cladding plate to a press for a compaction, packaging and welding with a vertical plate by first performing spot welding around the laminated composite plate then using submerged-arc welding, drilling at an end of the welded composite plate slab and vacuuming, and then closing the hole, to obtain the composite plate slab.

Wherein hot rolling is performed in step 3), i.e., the qualified composite plate slab after inspection is welded and sealed at its periphery, then it is vacuumed and fed to a heating furnace to be heated to a rolling temperature before rough rolling, and then it is fed to a rough rolling mill for rough rolling.

Wherein cold rolling is performed in step 3), i.e., the qualified composite plate slab after inspection is welded by spot welding at its periphery, then it is fed to a pickling device for pickling before rough rolling, and then it is fed to a rough rolling mill for rough rolling.

Wherein the corrugation of the composite surface is perpendicular to the rolling direction or parallel to the rolling direction in step 4).

Wherein corrugated section shapes of the cladding plate and the base plate formed by rough rolling are circular arc-shaped, oval, sinusoidal, triangular, trapezoidal or rectangular.

Wherein the corrugation heights of the cladding plate and the base plate composite surface are 10%-150% of the cladding plate thickness, and corrugation width of the cladding corrugated surface is 5-10 times of corrugation height thereof.

Wherein the method further comprises step 5), trimming, heat treatment, leveling and segmenting.

The present invention has the following advantages and effects:

The present invention may increase the binding force between the base plate and cladding plate by meshing force between the base plate corrugation and cladding plate corrugation; eliminates the differences of the metal plastic deformation due to the different deformation resistance of dissimilar metals by the bonding of the whole corrugated cladding plate and the toothed surface of the base plate; increase contact area between the base plate and cladding plate by slab-composing processing, increase bonding strength of the metal layers, and improve the compositing efficiency by avoiding cracking phenomenon of the base plate and cladding plate during rolling; and the method for rolling a metal composite plate by corrugated composite surfaces mating has simple process, lower energy consumption, and high compositing quality and yield.

BRIEF DESCRIPTION OF REFERENCE NUMERALS

1.1'-cladding plate;
2-base plate ;
3-upper rough rolling roll
4-lower rough rolling roll ;
5-upper working roll of finish rolling ; and
6-lower working roll of finish rolling.

DETAILED DESCRIPTION OF THE EMBODIMENTS

The present invention will be further described in detail with reference to the drawings and the embodiments. It should be understood that the concrete embodiments described herein are only used to illustrate the present invention, and not used to limit the present invention.

Figure 1:
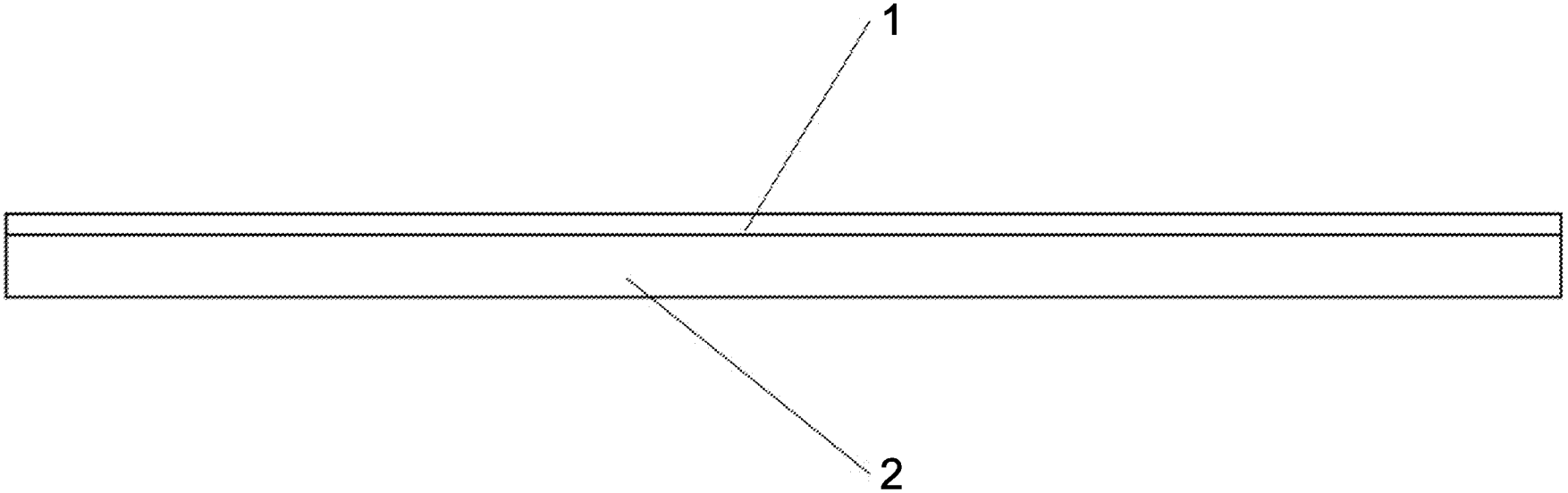
FIG. 1 is a schematic view of a one-side composite plate slab.

Embodiment 1: Preparation of titanium steel-carbon steel one-side composite plate Making a slab: selecting TC4 titanium steel plate and Q345R carbon steel plate according to the proportion of 1:4 to compose a slab, wherein the titanium steel plate has a size of 40 mm (thickness)×1500 mm (width)×3000 mm (length) and is used as cladding plate 1, and the carbon steel plate has a size of 160 mm (thickness)×1500 mm (width)×3000 mm (length) and is used as base plate 2; cleaning the carbon steel plate and titanium steel plate until the metal matrixes are exposed; laminating the cladding plate 1 and the base plate 2; feeding them to a press for a compaction, packaging and welding with a carbon steel of 15 mm thick by first performing spot welding around the laminated composite plate slab then using submerged-arc welding, drilling at an end of the welded composite plate slab and vacuuming, and then closing the hole, to obtain the composite plate slab, as shown in FIG. 1, wherein the thickness of the composite plate slab is 200 mm.

Heating: feeding the qualified composite plate slab after inspection to a heating furnace, and heating to 1200° C.

Figure 2:
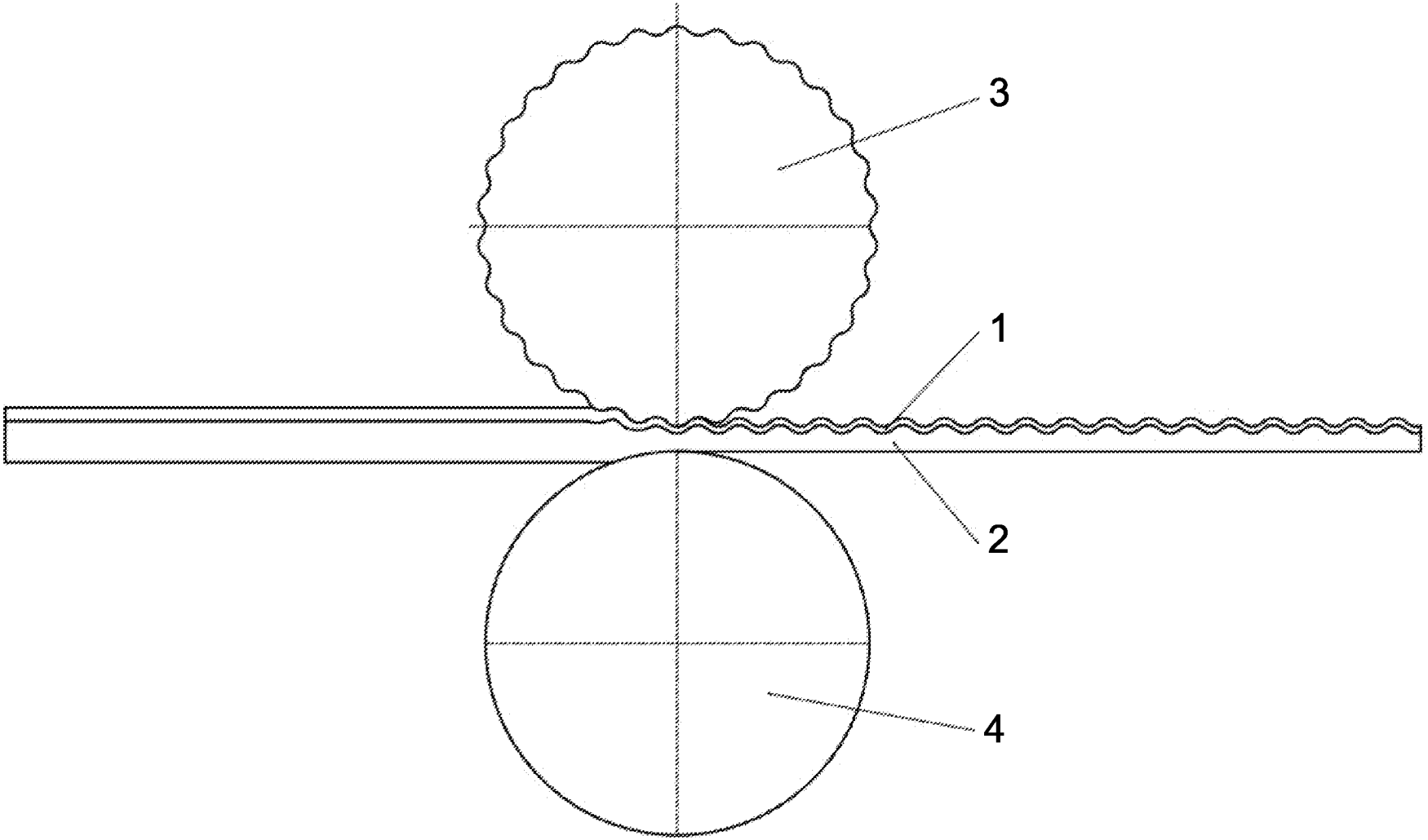
FIG. 2 is a schematic view of rough rolling of the one-side composite plate.
Figure 3:
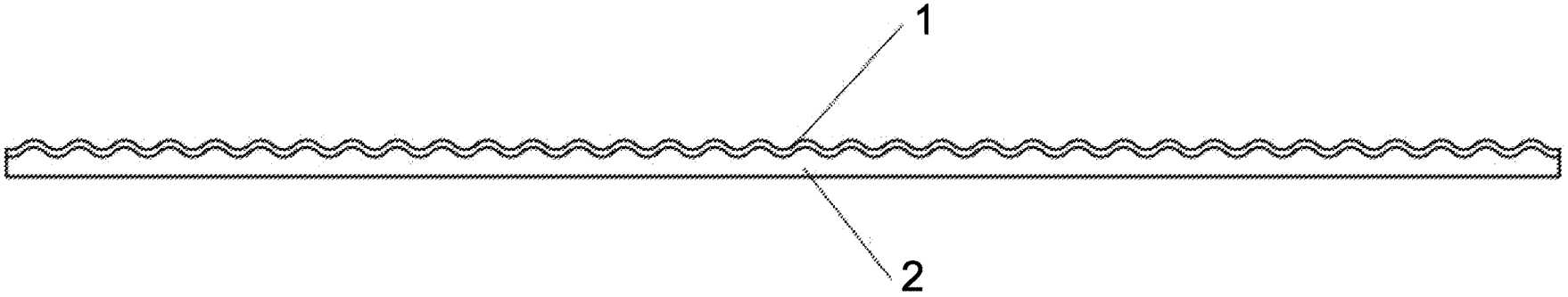
FIG. 3 is a semi-finished product of one-side composite plate with circular arc-shaped corrugated cladding plate after rough rolling.
Figure 4:
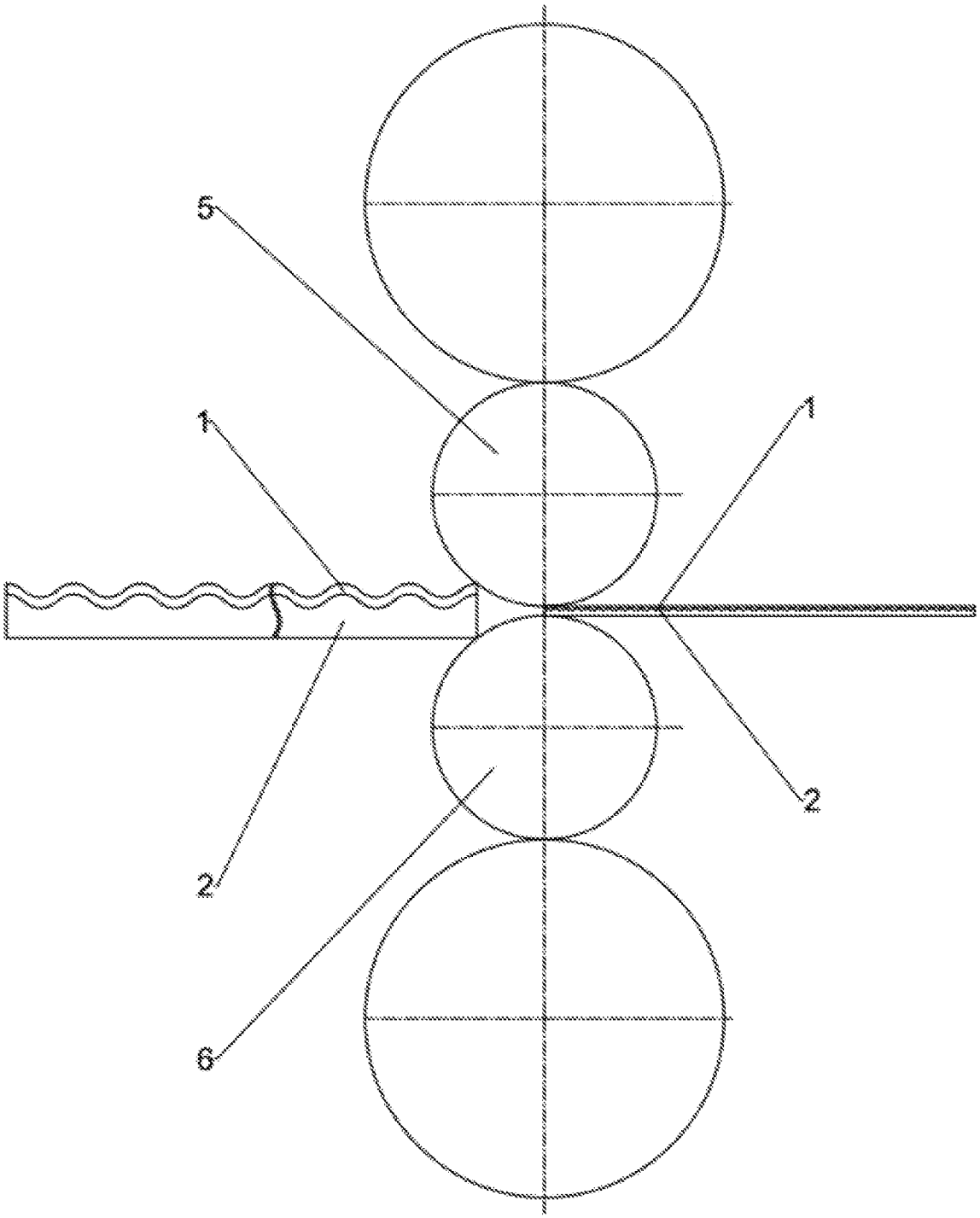
FIG. 4 is a schematic view of finish rolling of the one-side composite plate.
Figure 5:
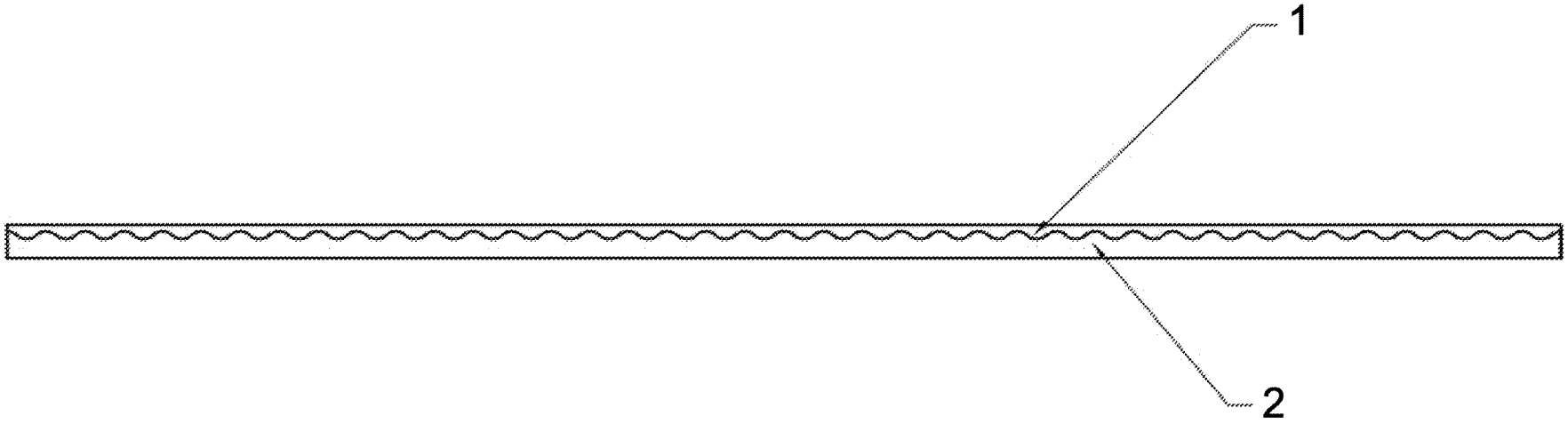
FIG. 5 is a finished product of composite plate with circular arc-shaped corrugated bonding surface after finish rolling.

Rough rolling: feeding the heated composite plate to a composite rough rolling mill for rolling, as shown in FIG. 2, wherein the composite rough rolling mill is a two-high rolling mill with one roll having circular arc-shaped toothed surface and the other roll having smooth surface so that the rolling is performed by allowing the roll having toothed surface to be in contact with the cladding plate and the roll having smooth surface to be in contact with the base plate; rolling the titanium steel-carbon steel composite plate slab along a rolling direction to form a rough rolling composite plate in which the titanium steel cladding plate is a whole circular arc-shaped corrugated plate, and composite surfaces of the carbon steel base plate 2 and the titanium steel cladding plate 1 ate mated with each other by circular arc-shaped corrugations, as shown in FIG. 3, wherein the arc-shaped width of the circular arc-shaped corrugated surface of the cladding plate 1 is 5 times of the arc-shaped height thereof, circular arc-shaped corrugation height is 30 mm, and circular arc-shaped corrugation is distributed continuously along a length direction.

finish rolling: as shown in FIG. 4, feeing the one-side circular arc-shaped corrugated composite plate after rough rolling to a four-high finish rolling mill for rolling, wherein the working roll 5, 6 and support rolls of the finish rolling mill are all flat rolls having smooth surfaces, arranging the corrugation of the rough rolling composite plate along the rolling direction, and rolling by the finish rolling mill until the rough rolled composite plate with one-side circular arc-shaped corrugation is rolled into a two-side planar finished product composite plate with 20 mm thickness, as shown in FIG. 5.

And finally trimming, performing heat treatment, leveling, and segmenting, to form a finished product.

Figure 6:
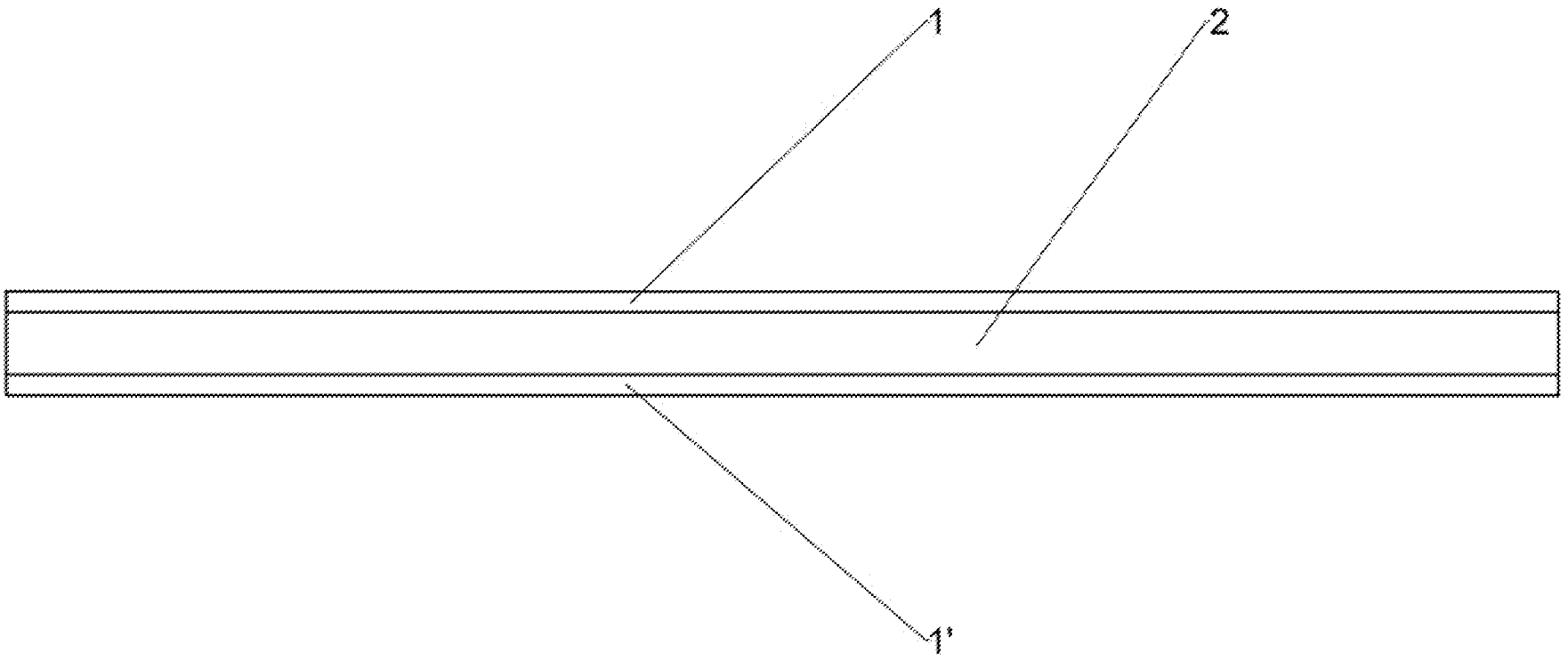
FIG. 6 is a schematic view of a two-side composite plate slab.

Embodiment 2: Preparation of copper plate copperplate-aluminum plate-copper plate two-side composite plate:

Make a slab: selecting a T3 copper plate, a LY2 aluminum plate and a T3 copper plate according to a proportion of 1:3:1 to compose a slab, wherein the aluminum plate has a size of 120 mm (thickness)×800 mm (width)×3000 mm (length) and is used as base plate 2, two copper plates have a size of 40 mm (thickness)×800 mm (width)×3000 mm (length) and respectively used as upper cladding plate 1 and lower cladding plate 1'; cleaning the aluminum plate and two copper plates until the metal matrixes are exposed; laminating the lower cladding plate 1', the base plate 2 and the upper cladding plate, feeding to a press for a compaction, and welding around the laminated composite plate slab by using spot welding, to obtain a composite plate slab with a thickness of 200 mm, as shown in FIG. 6.

Pickling: feeding the qualified composite plate after inspection to a pickling device for pickling.

Figure 7:
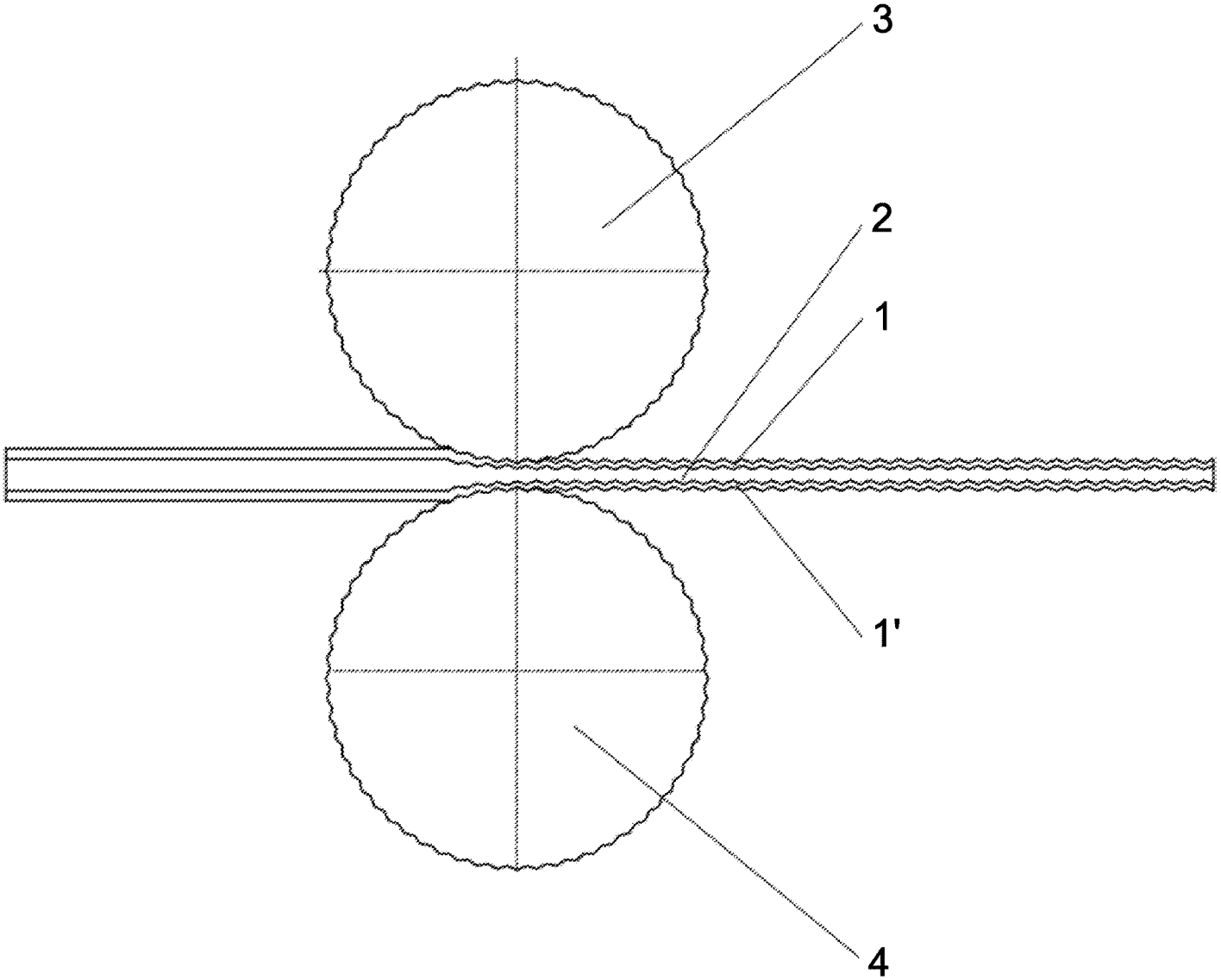
FIG. 7 is a schematic view of rough rolling of the two-side composite plate.
Figure 8:
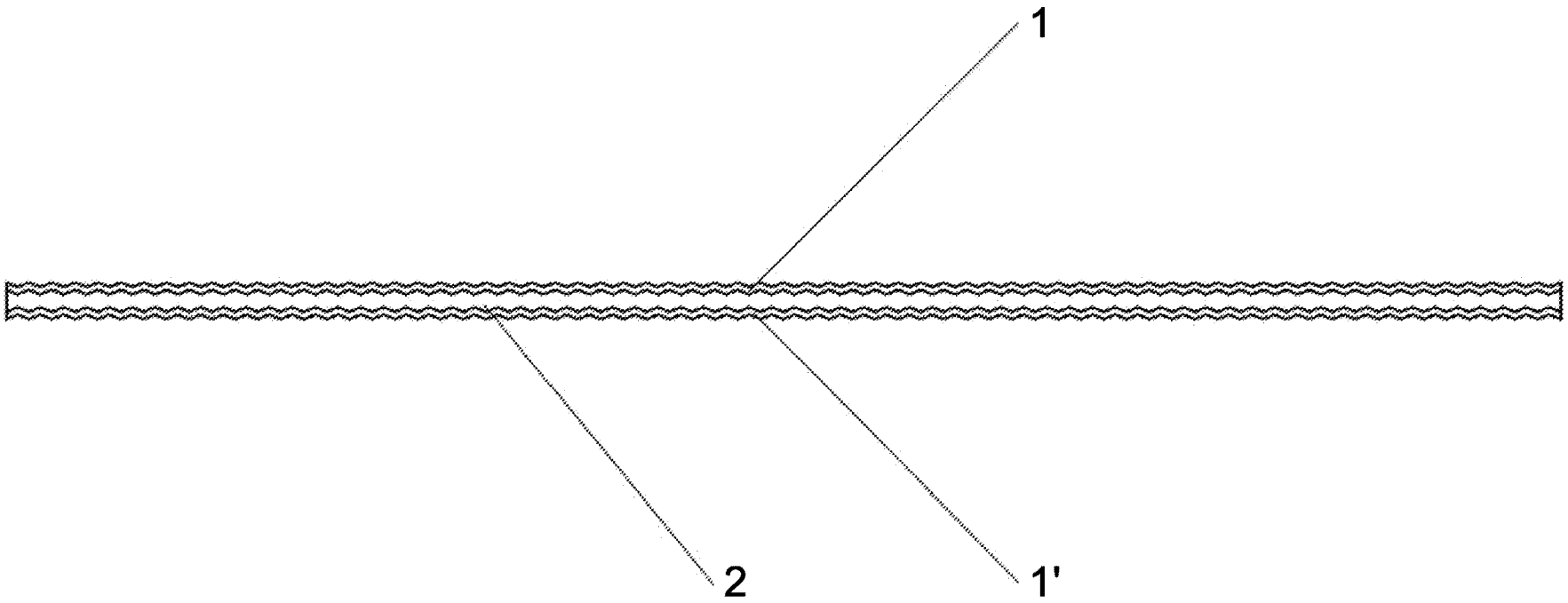
FIG. 8 is a semi-finished product of two-side composite plate with triangular corrugated cladding plate after rough rolling.

Rough rolling: feeding the qualified composite plate after pickling to a composite rough rolling mill for rolling, as shown in FIG. 7, wherein the composite rough rolling mill is a two-high rolling mill with both rolls having triangular toothed surfaces; rolling the upper copper plate cladding plate 1 and the lower copper plate cladding plate 1' along a rolling direction to form a rough rolled composite plate with a whole triangular corrugated cladding plate in which the bonding surfaces of the base plate 2 and the upper cladding plate are triangular corrugated surfaces mating with each other, and the bonding surfaces of the base plate 2 and the lower cladding plate 1' are also are triangular corrugated surfaces mating with each other, and triangular corrugation width is 10 times of triangular corrugation height, triangular corrugation height is 15 mm, and triangular corrugation is distributed continuously along a length direction.

Figure 9:
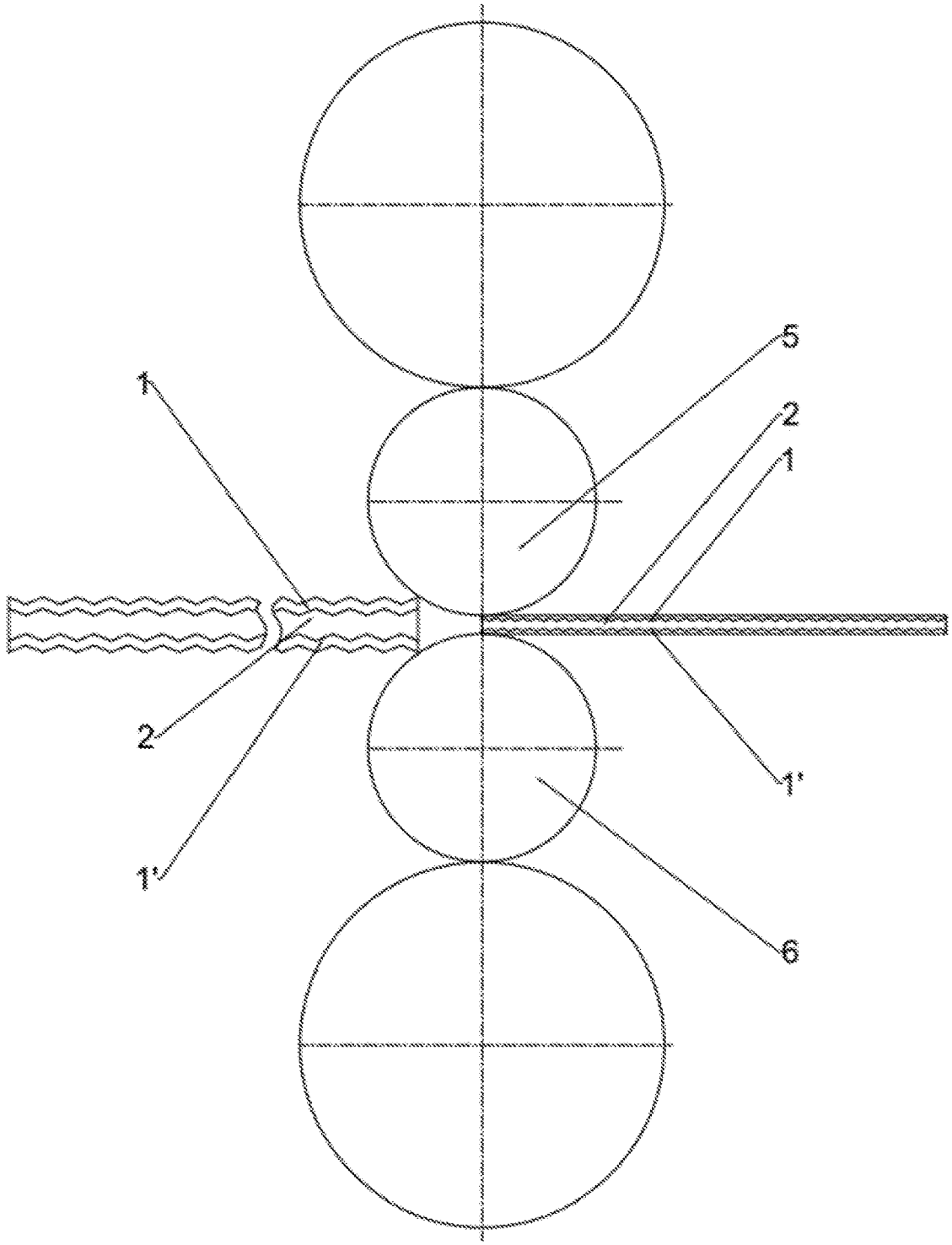
FIG. 9 is a schematic view of finish rolling of the two-side composite plate.
Figure 10:
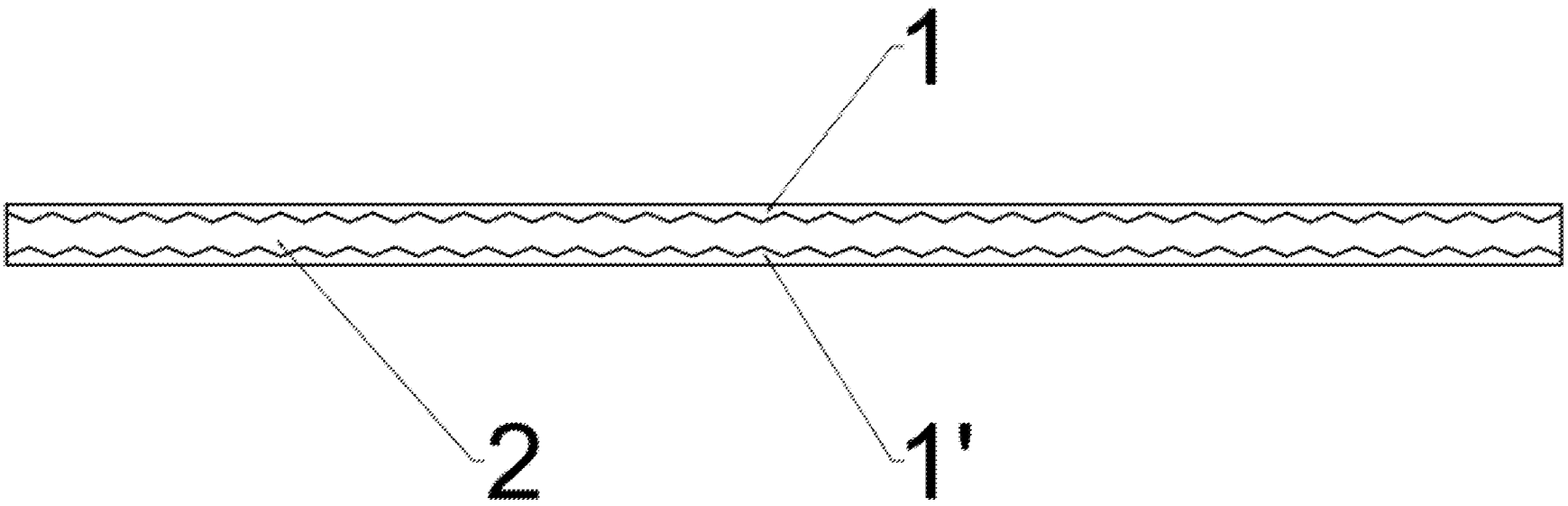
FIG. 10 is a finished product of composite plate with triangular corrugated bonding surface after finish rolling.

Finish rolling: feeding the two-side triangular corrugated composite plate after rough rolling to a four-high compositing finish rolling mill for rolling, as shown in FIG. 9, wherein the working roll 5, 6 and support rolls of the four-high finish rolling mill are all flat rolls having smooth surfaces, arranging the corrugation of the rough rolled composite plate along the rolling direction, and rolling by the four-high finish rolling mill until the rough rolled composite plate with two-side triangular corrugation is rolled into a two-side planar finished product composite plate with a thickness of 12 mm, as shown in FIG. 10; and then rolling by a six-high finish rolling mill to obtain a composite thin strip with a thickness of mm.

And finally trimming, performing heat treatment, and leveling, to form a finished product.

The corrugations are continuously and uniformly distributed on the base plate 2 and cladding plate 1 during the rough rolling, and the corrugations of the composite surfaces are perpendicular to or parallel to a rolling direction during finish rolling. The cladding plate 1 with a deformation resistance greater than that of the base plate 2 should be selected when the materials are selected.

Corrugated section shapes of the cladding plate formed by rough rolling are circular arc-shaped, oval, sinusoidal, triangular, trapezoidal or rectangular, and the corrugation height of the cladding plate is 10%-150% of the thickness of the cladding plate; and base plate composite surface is one-side corrugated after rough rolling , and corrugated section shapes of the cladding plate are circular arc-shaped, oval, sinusoidal, triangular, trapezoidal or rectangular, and the corrugation height of the base plate composite surface is 10%-150% of the thickness of cladding plate.

In the two embodiments, the binding force between the base plate and the cladding plate is increased by meshing force between the base plate corrugation and cladding plate corrugation. The differences of the metal plastic deformation due to the different deformation resistance of dissimilar metals is eliminated by the bonding of the whole corrugated cladding plate and the toothed surface of the base plate, with a good composite effect. The bonding strength of the metal interface has substantially improved compared to the bonding strength by using planar plate.

What is claimed is:

1. A method for rolling a metal composite plate/strip, comprising:

1) selecting a base plate and a cladding plate, cleaning surfaces of the base plate and the cladding plate to be composited until their metal matrixes are exposed;

2) sequentially laminating the base plate and the cladding plate to obtain a composite plate slab having a flat top surface of the cladding plate, a flat bottom surface of the base plate, and a flat composite interface between the base plate and the cladding plate;

3) rolling the composite plate slab through a composite rough rolling mill having a circular arc-shaped corrugated roll to obtain a composite plate having a circular arc-shaped corrugated mating interface on its composite interface, a circular arc-shaped corrugated top surface that is in parallel to the circular arc-shaped corrugated mating interface, and the flat bottom surface; and 4) flattening the circular arc-shaped corrugated top surface of the composite plate having a complete circular arc-shaped corrugated cladding plate by a composite finish rolling mill to a desirable thickness to obtain a composite plate/strip having the circular arc-shaped corrugated mating interface between the base plate and the cladding plate.

2. The method for rolling a metal composite plate/strip according to claim 1, wherein the cladding plate is one piece, the deformation resistance of the cladding plate is greater than that of the base plate, and the composite rough rolling mill is a two-high rolling mill with one roll having toothed surface and the other roll having smooth surface so that the rolling is performed by allowing the roll having toothed surface to be in contact with the cladding plate and the roll having smooth surface to be in contact with the base plate.

3. The method for rolling a metal composite plate/strip according to claim 1, wherein the cladding plate is two pieces located respectively at the upper and lower surfaces of the base plate, the deformation resistance of the cladding plates is greater than that of the base plate, and the composite rough rolling mill is a two-high rolling mill with both rolls having toothed surfaces so that the rolling is performed by allowing the rolls having toothed surface to be in contact with the upper and lower cladding plates.

4. The method for rolling a metal composite plate/strip according to claim 1, wherein the step 2) further comprises: feeding the laminated base plate and cladding plate to a press for a compaction, packaging and welding with a vertical plate by first performing spot welding around the laminated composite plate and then using submerged-arc welding drilling at an end of the welded composite plate slab and vacuuming, and then closing the hole, to obtain the composite plate slab.

5. The method for rolling a metal composite plate/strip according to claim 1, wherein the step 3) further comprises: before rough rolling, welding the composite plate slab after inspection and sealing at its periphery, then vacuuming the composite plate slab and feeding the composite plate slab to a heating furnace to be heated to a rolling temperature, and then feeding the composite plate slab to a rough rolling mill for rough rolling.

6. The method for rolling a metal composite plate/strip according to claim 1, wherein the step 3) further comprises: before rough rolling, welding the composite plate slab after inspection by spot welding at its periphery, feeding the composite plate slab to a pickling device for pickling, and then feeding the composite plate slab to a rough rolling mill for rough rolling.

7. The method for rolling a metal composite plate/strip according to claim 1, wherein the corrugation of the composite interface is perpendicular to the rolling direction or parallel to the rolling direction in step 4).

8. The method for rolling a metal composite plate/strip according to claim 1, wherein the corrugation heights of the cladding plate and the base plate composite interface are 10%-150% of the cladding plate thickness, and a corrugation width of the corrugated mating interface between the base plate and the cladding plate is 5-10 times of a corrugation height thereof.

9. The method for rolling a metal composite plate/strip according to claim 1, further comprises step 5), trimming, heat treatment, leveling and segmenting.

* * * * *